United States Patent [19]

Chiu

[11] 4,323,995

[45] Apr. 6, 1982

[54] CHIME UNIT FOR ELECTRIC CLOCK AND MECHANICAL CLOCK

[76] Inventor: Te-Long Chiu, 6990 Grandwood Way, San Jose, Calif. 95120

[21] Appl. No.: 113,287

[22] Filed: Jan. 18, 1980

[51] Int. Cl.[3] ..... G04B 21/02; G04B 21/00

[52] U.S. Cl. ..... 368/75; 368/273

[58] Field of Search ..... 340/484 E; 368/75, 273, 368/72, 73, 250, 272

[56] References Cited

U.S. PATENT DOCUMENTS

| | | | |
|---|---|---|---|
| 4,073,133 | 2/1978 | Earls et al. | 368/273 |
| 4,090,349 | 5/1978 | Takase | 340/384 E |
| 4,098,071 | 7/1978 | Kawakami et al. | 368/73 |
| 4,148,181 | 4/1979 | Scheer | 368/273 |
| 4,172,359 | 10/1979 | Gorsky et al. | 368/273 |
| 4,245,336 | 1/1981 | Stietenroth | 368/273 |
| 4,251,877 | 2/1981 | Scheer | 368/75 |
| 4,271,495 | 6/1981 | Scherzinger et al. | 368/75 |

*Primary Examiner*—Vit W. Miska

[57] ABSTRACT

The chime unit of pre-programmed melody type and that of programmable melody type for the electric clock and the mechanical clock. The chime units consist of the hour and the minute hands position sensing means using magnetic Reed switches or photo-transistors, melody decoding circuits using D-type Flip Flop to trigger counters to provide proper addressing signals to ROMs or RAMs, ROMs or RAMs which contain pre-programmed control signals of multiplexers, notes synthesizer generating all tones needed as input to multiplexers, multiplexers for selecting and mixing the tones from notes synthesizer to form the chime notes, decay generator and voltage controlled amplifier to provide decaying characteristics of chime notes, and speaker to convert electrical signal to mechanical sound. For the programmable melody type, there is an additional notes decoder to convert the notes to the control signals of the multiplexers and store in RAMs.

6 Claims, 4 Drawing Figures

CHIME UNIT FOR ELECTRIC CLOCK AND MECHANICAL CLOCK

BACKGROUND OF THE INVENTION

This invention relates to new types of chime units for the electric clock and the mechanical clock by electronic means.

The chime units available today are of mechanical type such as the chime units in the grandfather clocks or of the electronic type such as the chime units in the digital electronic clocks sold by HEATHKIT ELECTRONIC CENTER. These two types of chime units can not play any other tunes other than the one that is designed-in during the manufacturing of the chime units.

It is the principle object of this invention to provide the chime units that can play different tunes by replacing only the ROMs or by programming the RAMs. Another object is to provide the chime units to the electric clock and the mechanical clock through electronic means.

SUMMARY OF THE INVENTION

In accordance with the embodiment of the invention, the hour and the minute hands position sensing circuits provide signals to the melody decoding circuits, which in turns trigger counters to provide addressing signals to generate the control signals for multiplexers from ROMs or RAMs. The multiplexers select and mix proper tones from notes synthesizer to generate the chime notes as the input signals to the voltage controlled amplifier. The voltage gain of the voltage controlled amplifier is in turns controlled by the decay generator to provide the decaying characteristics of the chime notes. The melody that the chime unit plays can be changed by replacing ROMs in the pre-programmed melody type and by programming the RAMs in the programmable melody type.

BRIEF DESCRIPTION OF THE DRAWINGS

The novel features believed characteristics of the invention are set forth in the appended claims. The invention itself and other features as well as advantages thereof, can best be understood by reference to the detailed description which follows, read in conjunction with the accompanying drawings, wherein:

DETAILED DESCRIPTION OF SPECIFIC EMBODIMENT

Figure 1:
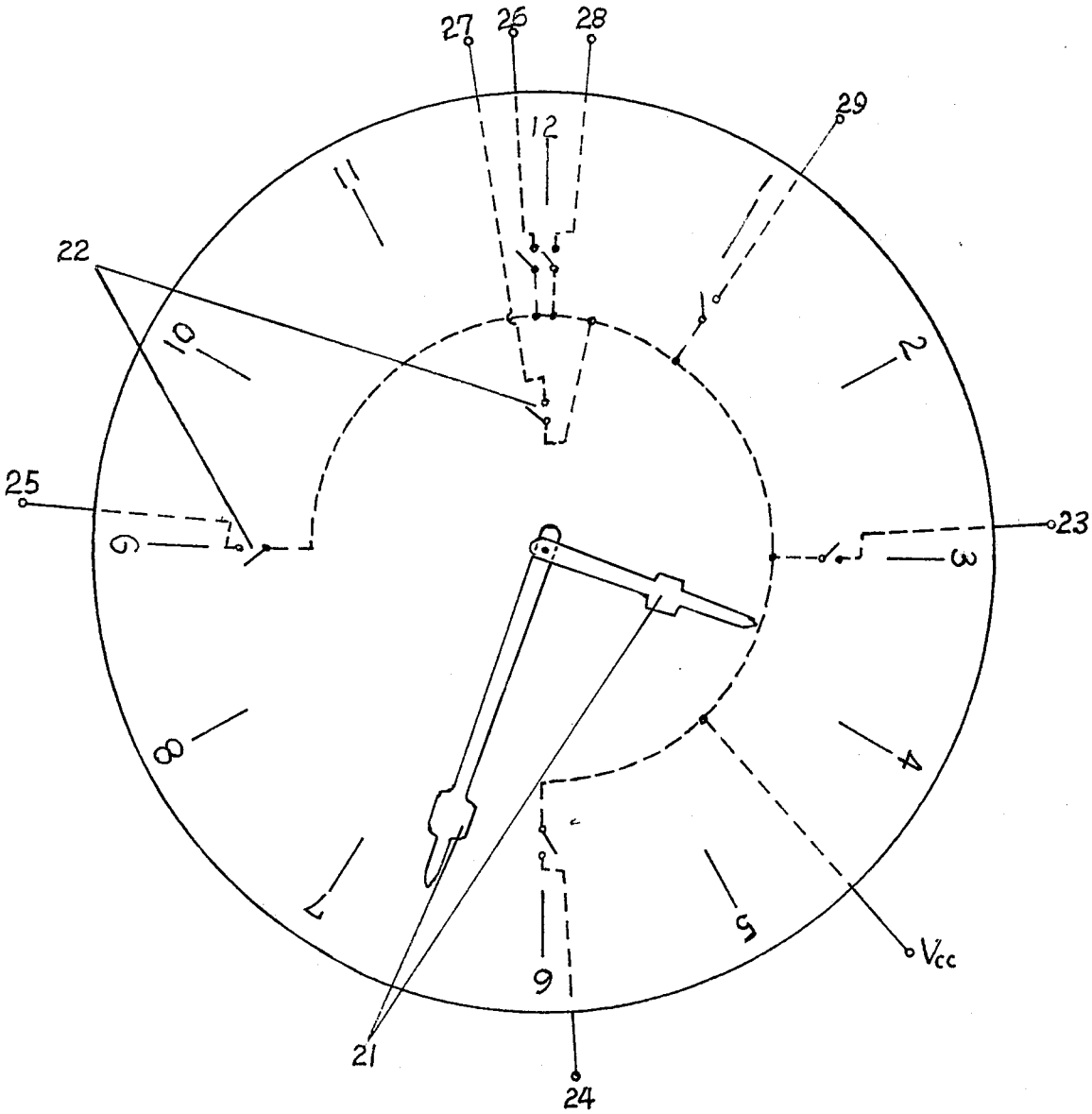
FIG. 1 is the top view of the clock face with the magnetic Reed switches for sensing the position of the hour and the minute hands attached to the back of the clock face, and magnets attached to the hour and the minute hands of the clock.

FIG. 1 is the top view of the clock face with the magnetic Reed switches 22 for sensing the position of the hour and the minute hands attached to the back of the clock face. The magnets 21 are attached to the hour and the minute hands. As the magnet 21 on minute hand is passing over the magnetic Reed switch 22, the magnetic reed switch 22 changes from open to close and Vcc appears at one of the terminals 23–26,28, and 29. Similarly, as the magnet 21 on the hour hand is passing over the magnetic Reed switch 22, Vcc appears at the terminal 27. Therefore, the voltage at terminals 23–29 indicates whether the minute hand is at 15,30,45,59,60, or 5 minute position, and whether the hour hand is at 12 o'clock position.

Figure 2:
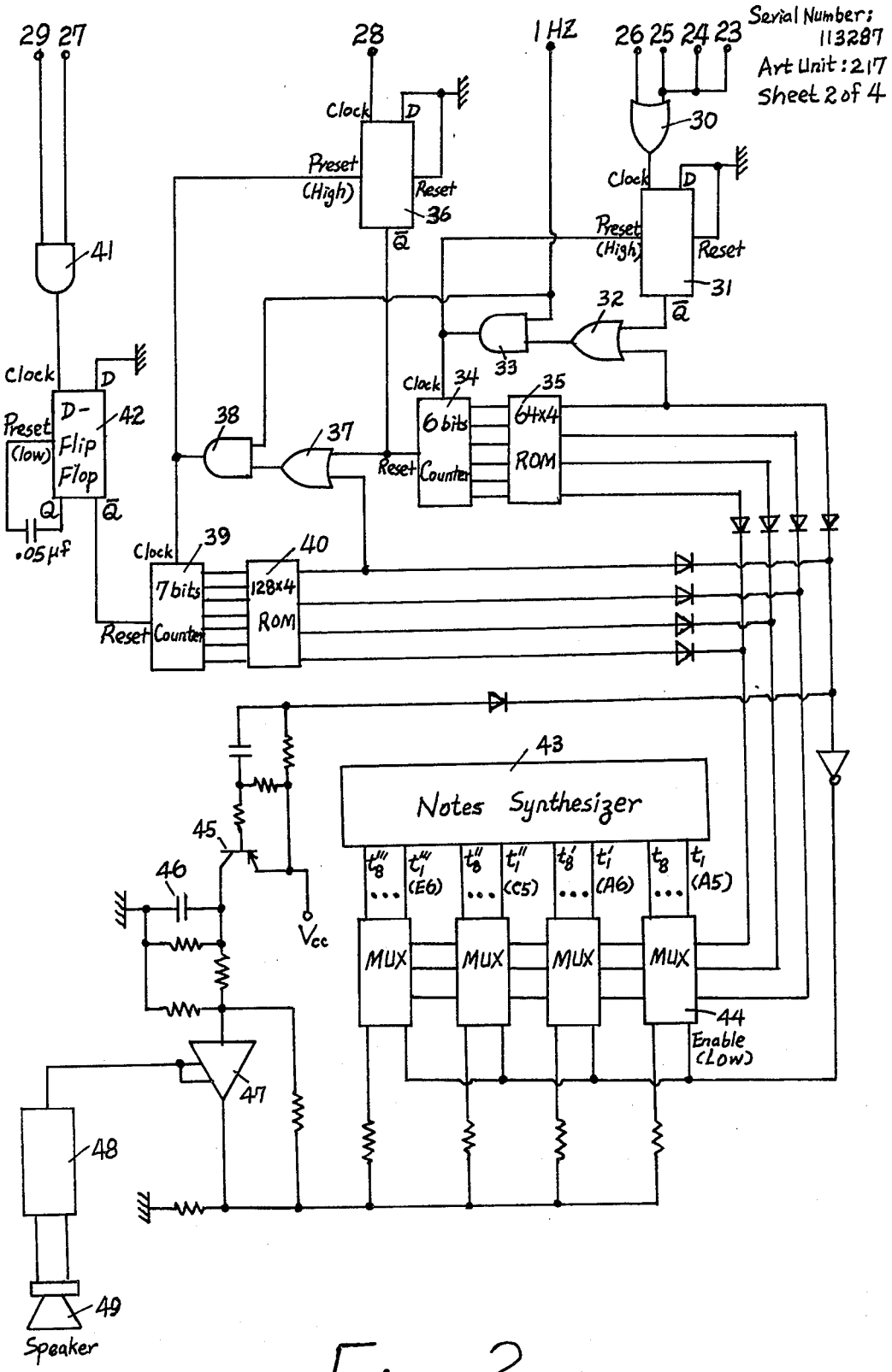
FIG. 2 is the detailed circuit of one embodiment of the pre-programmed melody type chime unit.

FIG. 2 is the detailed circuit of one embodiment of the pre-programmed chime unit. Referring to FIG. 2, the voltages generated at the terminals 27 and 29 at 12:05 AM or PM reset the 7 bits counter 39 which provides address signals to 128×4 ROM 40. The 128×4 ROM 40 contains the control signals of multiplexers 44 for generating the hourly chimes. The voltage generated at the terminal 28 at even hour advances the 7 bits counter 39 by one count, and generates the next control signals of multiplexers 44 from 128×4 ROM 40. The output signals from 128×4 ROM 40 also contain the information whether to advance the 7 bits counter 39 by one more count. Similarly, the voltage generated at the terminal 28 at even hour resets the 6 bits counter 34 which provides address signals to 64×4 ROM 35. The 64×4 ROM 35 contains the control signals of multiplexers 44 for generating chime melody quarterly. The voltage generated at one of the terminals 23–26 at 15,30,45,and 59 minutes hourly advances the 6 bit counter 34 by one count, and generates the next control signals of multiplexers 44 from 64×4 ROM 35. The output signals from 64×4 ROM 35 also contain the information whether to advance the 6 bits counter 34 by one more count. Detailed description of the circuit operation is given below.

As the magnet 21 on the minute hand is passing over the magnetic Reed switch 22 at 15,30,45, or 59 minute position, a positive voltage appears at the terminal 23,24,25, or 26 as the input to the OR gate 30, and the output voltage of the OR gate 30 also changes from low to high state. This positive transition of voltage appears as the input clock signal to the D-type Flip Flop 31 and triggers the output $\bar{Q}$ to change from low to high state, and the output of OR gate 32 also change from low to high state. As the 1 Hz signal becomes positive, the output of AND gate changes from low to high state and appears as the input clock signal to the 6 bits counter 34 and as the reset signal to D-type Flip Flop 31 to return the output $\bar{Q}$ to low state. The output of the 6 bits counter 34 is increased by one count as the consequence, and appears as the address signals to the 64×4 ROM 35 and causes the pre-programmed control signals for the multiplexers 44 to appear at the four output terminals of the 64×4 ROM 35. The 64×4 ROM 35 is for generating chime melody quarterly. The three out of four output terminals are connected to the address input of the multiplexers 44 to select one input terminal to be connected to the output terminal of the multiplexers 44. The fourth output terminal is connected to the enable terminal of the multiplexers 44 through an inverter. The high state at the fourth output terminal changes the enable terminal of the multiplexers 44 to low state and enables the multiplexers 44. The high state at the fourth output terminal also changes the output of the OR gate 32 to high state, and the output of the AND gate 33 changes from low to high state as the 1 Hz signal becomes positive. Thus, the 6 bits counter 34 advances by one count if the fourth output terminal of the 64×4 ROM 35 is at high state. On the other hand, the 6 bits counter 34 remains at the same state if the fourth output terminal of the 64×4 ROM 35 is at low state. When the enable terminal of the multiplexers 44 is at low state, the four multiplexers 44 are enabled and four different tones are selected by the address input signals from the three out of four output terminals of the 64×4 ROM 35 and mixed through the resistors connected to the output terminals of the multiplexers 44 to generate the chime notes. The resultant chime notes appears at the input of the voltage controlled amplifier 47. The decay generator consists of the transistor 45 and the capacitor 46 and several resistors and capacitor. The output of the decay generator is connected to the gain control input of the voltage controlled amplifier 47. As the fourth output terminal of 64×4 ROM 35 is at low state, the transistor 45 is turned on to charge the capacitor 46. As the fourth output terminal of 64×4 ROM 35 changes to high state, the transistor 45 is turned off and the voltage across the capacitor 46 is discharged through resistors and decays gradually. Consequently, the gain of the voltage controlled amplifier 47 also decreases gradually and creates the decaying chime characteristics at the output of the voltage controlled amplifier 47. This output signal is further amplified by the audio amplifier 48, and is converted to chime through the speaker 49.

As the magnet 21 on the minute hand is passing over the magnetic Reed switch 22 at 60 minute position, the positive voltage at the terminal 28 generates a voltage pulse at the output terminal $\bar{Q}$ of the D-type Flip Flop 36. This voltage pulse resets the 6 bits counter 34 and increases the output of the 7 bits counter 39 by one count which functions as the address signal to 128×4 ROM 40. The 128×4 ROM 40 is for generating hourly chimes.

As the magnets 21 on the minute hand and the hour hand are passing over the magnetic Reed switches 22 at 5 minute and 12 o'clock position respectively, the positive voltages appear at terminal 29 and 27. The output of the AND gate 41 changes from low to high state and appears as the input clock signal to the D-type Flip Flop 42. The output voltage Q feeds back to the preset terminal of the D-type Flip Flop through 0.05 uf capacitor. As the consequence, a positive voltage pulse is generated at the $\bar{Q}$ output of the D-type Flip Flop 42 and reset the 7 bits counter 39.

The programmable melody type chime unit is similar to the pre-programmed melody type chime unit except in the following aspects: (a) ROMs are replaced by RAMs. (b) Additional notes decoder is needed. (c) A 7 poles 3 positions switch is needed for selecting the RAM to be programmed.

Figure 3:
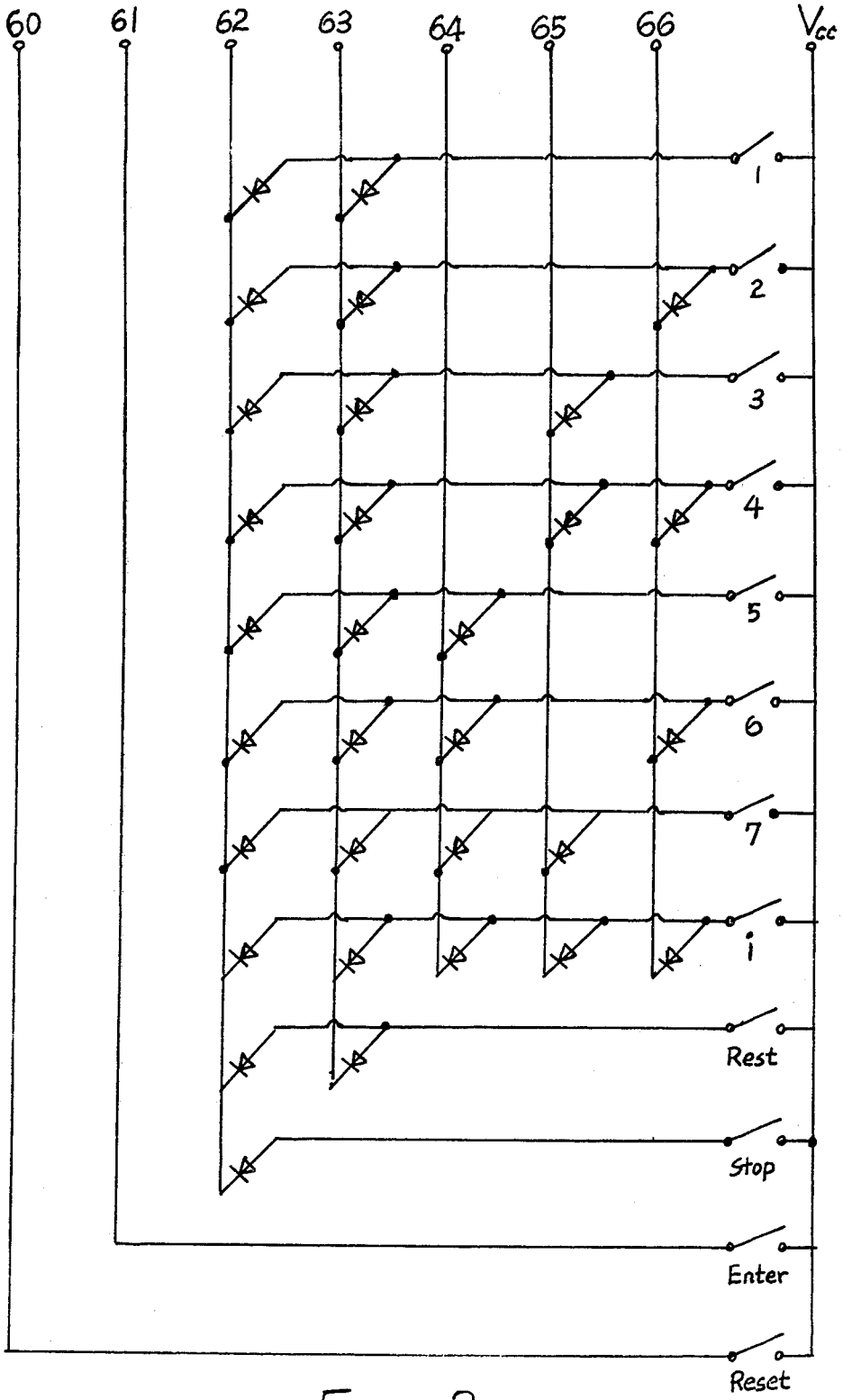
FIG. 3 is the detailed circuit of one embodiment of the notes decoder for the programmable melody type chime unit.

The notes decoder is shown in FIG. 3. The notes decoder is to convert the notes into the multiplexer control signals and stored in RAMs. All switches shown in FIG. 3 are push to close type. The reset switch is for resetting the counters 74 and 81 in FIG. 4. The enter switch is for advancing the output of the counters by 1. The stop switch is for the purpose of stopping the chime melody or hourly chime. The rest switch is for the purpose of providing the rest between notes. The 1 to 1 switches are for inputing the notes into RAMs.

Figure 4:
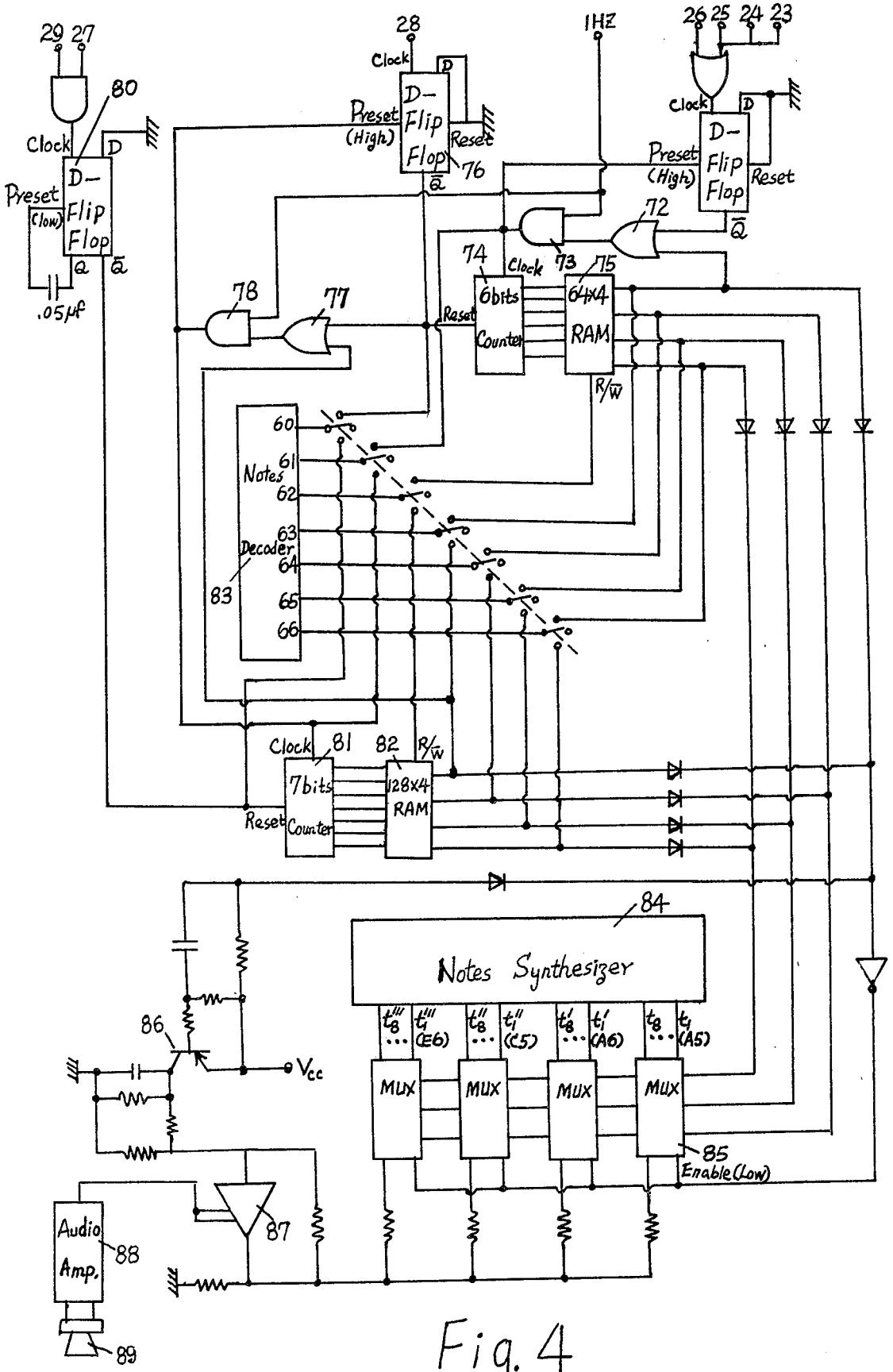
FIG. 4 is the detailed circuit of one embodiment of the programmable melody type chime unit.

FIG. 4 is the detailed circuit of one embodiment of the programmable melody type chime unit. The notes decoder 83 is connected to the 7 poles 3 position switches. The 7 poles 3 position switches should be left at the middle position during the operation as the chime unit.

Although the invention has been described with reference to the illustrative embodiments, the description is not intended to be construed in a limiting sense. Various modifications of the illustrative embodiments and other embodiments of the invention will be apparent to persons skilled in the art upon reference to this description. It is therefore contemplated that the appended claims will cover any such modifications or embodiments as fall within the true scope of the invention.

What is claimed is:

1. An electronic chime unit for electric and the mechanical clock comprising:

a quarter hourly signal generator consisting of quarter hourly position sensors, a flip flop, and a plurality of logic gates to receive a low frequency pulse as gating signal, and to a deliver quarter hourly triggerring signal to a quarter hourly address counter and to provide a feedback signal to reset the said flip flop back to original state after delivering the quarter hourly signal to quarter a hourly address counter;

a quarter hourly address counter to receive the triggerring signals from the said quarter hourly signal generator and from an output terminal of a quarter hourly chime memory, and to receive a reset signal from an hourly signal generator, and to provide address signals to the said quarter hourly chime memory;

a quarter hourly chime memory to receive address signals from the said quarter hourly address counter, and to provide notes selection signals to a chime note generation circuit, and to provide the triggerring signal to the said quarter hourly address counter when the quarter hourly chime music is not completed, and to provide an enable signal to the chime note generation circuit, and to provide the activation signal to a decay generator to initiate the R C discharging of the voltage;

an hourly signal generator consisting of an hourly position sensor, a flip flop, and plurality of logic gates to receive a low frequency pulse as gating signal, and to deliver an hourly triggerring signal to said hourly address counter, and to provide feedback signal to reset the said flip flop back to the original state after delivering the hourly triggerring signal to an hourly address counter, and to deliver a reset signal to the said quarter hourly address counter;

an hourly address counter to receive triggerring signals from the said hourly signal generator, and from an output terminal of an hourly chime memory, and to receive reset signal from post 12 o'clock signal generator, and to provide an address signal to said hourly chime memory;

an hourly chime memory to receive address signals from said hourly address counter, and to provide note selection signals to a chime note generation circuit, and to provide the triggerring signal to the said hourly address counter when the hourly chime music is not completed, and to provide the enable signal to the chime note generation circuit, and to provide the activation signal to the decay generator to initiate the R C discharging of the voltage;

a post 12 o'clock signal generator consisting of post 12 o'clock position sensor, a flip flop, and a capacitor, and an AND gate to deliver post 12 o'clock reset signal to said hourly address counter;

a memory signals combiner consisting of a plurality of diodes to combine the output terminals of the said quarter hourly chime memory and those of the said hourly chime memory into a single set of common output terminals;

a notes synthesizer to generate a set of single frequency notes as the input signals to the input lines of a chime note generation circuit;

a chime note generation circuit consisting of a plurality of multiplexers having common address lines and a common enable terminal to receive a specific different single frequency note at each of their input lines from said notes synthesizer, and to receive from the said common output terminals of the said memory signals combiner the notes selection signals and enable signal, respectively, at the common address lines and the common enable line, and to mix the single frequency notes at the output terminals of the said multiplexers through resistors and deliver the mixed notes as a chime note to the input terminal of the voltage controlled amplifier;

a decay generator consisting of a transistor, and a plurality of resistors and capacitors to receive the activation signal from one of the common output terminals of the said memory signals combiner to initiate the R C discharging of the voltage, and to deliver the decaying voltage to a gain control terminal of a voltage controlled amplifier;

a voltage controlled amplifier to receive the decaying voltage from the said decay generator to the gain control terminal, and to receive the chime note from the said chime note generation circuit, and to deliver the decaying chime note at the output terminal to the input terminal of the audio amplifier;

an audio amplifier to receive the decaying chime note from the said voltage controlled amplifier, and to deliver the amplified decaying chime note at the output terminal to the input terminals of an electro-mechanical transducer;

an electro-mechanical transducer to convert the amplified decaying chime note from the said audio amplifier into the audible chime sound.

2. An electronic chime unit according to claim 1, wherein said quarter hourly signal generator includes a D-type flip flop with its D terminal grounded, its clock terminal connected to the output of a first OR gate whose input terminals are connected to quarter hourly position sensors, its $\bar{Q}$ terminal connected to one input terminal of a second OR gate while the other terminal of said second OR gate is connected to one output line of said quarter hourly chime memory, and its preset terminal connected to the input terminal of said quarter hourly address counter and the output of an AND gate while one input terminal of said AND gate is connected to the output of said second OR gate and the other input terminal of the said AND gate is connected to a 1 Hz pulse.

3. An electronic chime unit according to claim 1, wherein said hourly signal generator includes a D-type flip flop with its D terminal grounded, its clock terminal connected to the hourly position sensor, its $\bar{Q}$ terminal connected to one input terminal of an OR gate while the other terminal of the said OR gate is connected to one output line of said hourly chime memory, and its preset terminal connected to the input terminal of said hourly address counter and the output of an AND gate while one input of said AND gate is connected to the output of said OR gate and the other input of the said AND gate is connected to a 1 Hz pulse.

4. An electronic chime unit according to claim 1, wherein said quarter hourly chime memory is a ROM.

5. An electronic chime unit according to claim 1, wherein said hourly chime memory is a ROM.

6. An electronic chime unit according to claim 1, wherein the said quarter hourly chime memory and the said hourly chime memory are of Random Access Memories, and it further includes a notes decoder to convert chime notes into chime note selection signals and a control signal for storing in the said quarter hourly chime memory and the said hourly chime memory, and the output of the said notes decoder are connected to poles of a multiple poles multiple positions switch while one set of positions of said switch and therefore said poles are connected to clock and reset terminals of said address counters and to read/write terminals and to memory input terminals of said Random Access Memory during storing the note selection signals and a control signal into the said Random Access Memory.

* * * * *